US008256768B2

(12) United States Patent
Krucinski

(10) Patent No.: US 8,256,768 B2
(45) Date of Patent: Sep. 4, 2012

(54) MODULE TO MODULE SKEW ALIGNMENT

(75) Inventor: Martin Krucinski, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/152,894

(22) Filed: Jun. 3, 2011

(65) Prior Publication Data

US 2011/0233857 A1 Sep. 29, 2011

Related U.S. Application Data

(62) Division of application No. 12/262,803, filed on Oct. 31, 2008, now Pat. No. 7,971,876.

(51) Int. Cl.
*B65H 5/00* (2006.01)

(52) U.S. Cl. ..... 271/264; 271/265.01; 271/176

(58) Field of Classification Search ..... 271/226, 271/227, 230, 249, 248, 253, 254, 255, 264, 271/265.01, 176
See application file for complete search history.

(56) References Cited

U.S. PATENT DOCUMENTS

| | | | |
|---|---|---|---|
| 5,774,153 | A | 6/1998 | Kuehnle et al. |
| 7,742,898 | B2 | 6/2010 | Vollmer et al. |
| 2004/0251607 | A1 | 12/2004 | Mandel et al. |
| 2006/0163801 | A1 | 7/2006 | Dejong et al. |

*Primary Examiner* — David H Bollinger
(74) *Attorney, Agent, or Firm* — Hoffman & Baron, LLP

(57) ABSTRACT

A method of aligning transport modules in a printing system, the method including passing at least one substrate media in a process direction through two adjacent belt driven transport modules with one of the two transport modules having a belt steering control disabled. Each of the two transport modules including a transport belt for engaging and conveying the at least one substrate media, which transfers skew between the two adjacent transport modules. The method including detecting a first cross-process position of the transport belt in one of the two adjacent transport modules using a first edge sensor and detecting a second cross-process position of the transport belt in the other of the two adjacent transport modules using a second edge sensor. Further, aligning the two adjacent transport modules based on a relative skew between the two transport modules indicated by the first cross-process position and the second cross-process position.

12 Claims, 3 Drawing Sheets

MODULE TO MODULE SKEW ALIGNMENT

CROSS-REFERENCE TO RELATED APPLICATIONS

This application is a divisional of U.S. patent application Ser. No. 12/262,803 filed on Oct. 31, 2008, the disclosure of which is incorporated herein in its entirety by reference.

BACKGROUND

1. Technical Field

The presently disclosed embodiments are directed to a method and system of aligning transport modules as could be used in a number of assemblies, such as for a substrate media handling assembly.

2. Brief Discussion of Related Art

In printing systems with a collection of modules transporting substrate media using belts, slight skew misalignment of the modules will cause the module exit and entry velocity vectors to be misaligned. As substrate media is transferred between two modules, the difference in these velocity vector accumulates. The accumulation will translate into substrate media positioning errors between module exit and entry points, particularly in a cross-process direction. Such errors can cause large push, pull or shearing forces to be generated, which transmit to the substrate media being transported. Medium and light-weight substrate media cannot generally support large forces, which will cause wrinkling, buckling or tearing of such media.

Additionally, in overprinting systems more than one module is used to print onto each substrate media. In a belt driven overprinting system, substrate media is transported by belts from an image transfer zone in one module to an image transfer zone in another module. Thus, pushing, pulling or shearing forces on the substrate media can lead to image and/or color registration errors due to undesirable substrate media position or motion through the image transfer zone.

SUMMARY

One disclosed feature of the embodiments is a method of aligning transport modules in a printing system, the method comprising a step (a) including passing at least one substrate media in a process direction through two adjacent belt driven transport modules with at least one module belt steering control disabled. The method also comprising a step (b) including detecting a position of at least one module transport belt in a cross-process direction using an edge sensor. Further, the method comprising a (c) including aligning the two adjacent transport modules based on the detected cross-process position.

Additionally the method can include passing another substrate media through one of the two adjacent transport modules and a further transport module adjacent thereto and aligning further transport module with the one of the two adjacent transport modules. Also, the steps (a) through (c) can be repeated for each adjacent pair of transport modules in the printing system. The substrate media can be at least 200 gsm in weight. Additionally, the substrate media can be at least as long as a minimum distance between modules whereby both adjacent modules simultaneously engage the substrate media. Further, the at least one disabled belt steering control can include all module belt steering controls. Wherein the detected module transport belt position can correspond to at least one of a module exit and a module entry position. Further, the method can include calculating a maximum difference between two adjacent module cross process positions using the equation:

$$\Delta x_C = -\sin(\theta)(L-S)$$

where L is a length of the substrate media, S is a module-to-module spacing and θ is the angular misalignment between two modules. Further still, the method can include calculating a maximum difference between two adjacent module process positions using the equation:

$$\Delta x_P = (1-\cos(\theta))(L-S).$$

Another disclosed feature of the embodiments is a system for aligning transport modules in a modular printer assembly. The system including at least two driven transport modules for altering substrate media passing therethrough. Each transport module including a transport belt for engaging and conveying the substrate media therethrough. The system also including at least one edge sensor on each of the two driven transport modules, the edge sensors detecting information relating to the module transport belt. The system further including at least one module alignment subsystem for aligning the two adjacent transport modules based on the detected position. The system additionally including an alignment substrate media for passing through the transport modules and transferring module skew between adjacent modules to their respective transport belts.

Additionally the system can include at least one additional driven transport module, wherein the at least two driven transport modules are disposed upstream of the additional driven transport module, wherein after alignment of the at least two driven transport modules, the at least one module alignment subsystem aligns the at least one additional driven transport module relative to the upstream modules. Also, the system can include a belt steering control system in a disabled state when the edge sensors are detecting information relating to the module transport belt for alignment of modules and in an enabled state after the modules are aligned. The at least one module alignment subsystem is a manual system controlled at least in part by a human operator or can be an automated system substantially controlled without the need for a human operator. Wherein a maximum difference between two adjacent module cross process positions can be determined by:

$$\Delta x_C = -\sin(\theta)(L-S)$$

where L is a length of the substrate media, S is a module-to-module spacing and θ is the angular misalignment between two modules. Also, wherein a maximum difference between two adjacent module cross process positions can be determined by:

$$\Delta x_C = -\sin(\theta)(L-S).$$

DETAILED DESCRIPTION

Figure 1:
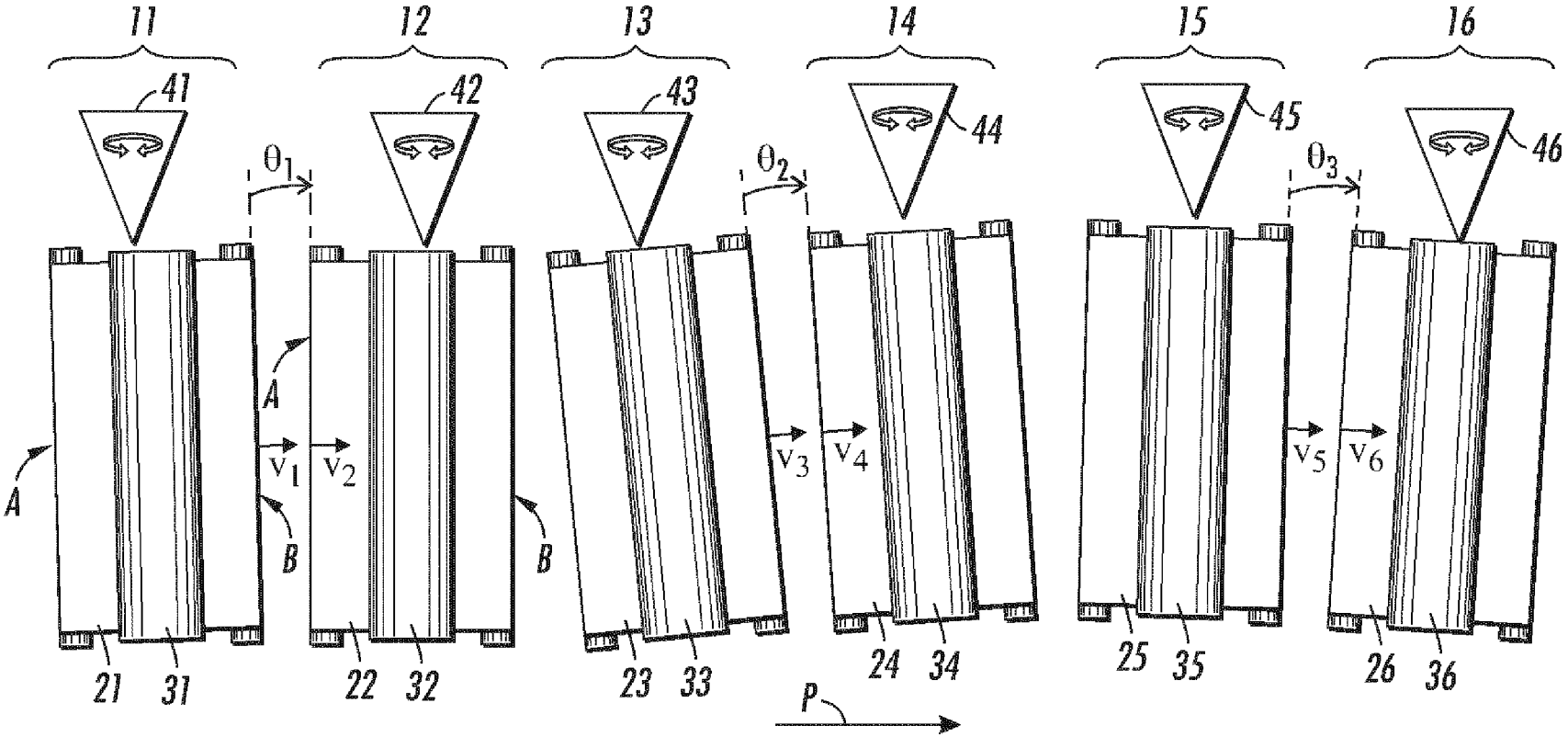
FIG. 1 is a plan view of a system for aligning substrate media overprint transport modules.

Describing now in further detail these exemplary embodiments with reference to the Figures, as described above the transport module alignment and/or de-skewing system and method are typically used for modular printing assemblies. Exemplary embodiments include a module-to-module skew alignment procedure and/or system for aligning transport modules in a printing system. Generally heavyweight and/or large alignment substrate media are passed through the system, with designated module belt steering control systems placed into a low gain, disabled or dead zone mode. In this way, any cross-process direction pushing or pulling caused by module-to-module skew misalignment is not counteracted by the steering control system. Then one or more sensors are used to detect belt movement in the cross-process direction during substrate media module-to-module transfer. Preferably, belt edge sensors are used to detect cross-process movement. Such belt edge sensors are preferably otherwise used during operation to steer the belts by detecting their cross-process position. The information from the sensor(s) is/are used to realign module-to-module skew, either manually by an operator or through automated systems.

As used herein, a "printing system" refers to one or more devices used to generate "printouts", which refers to the reproduction of information on "substrate media".

A printing system can use an "electrostatographic process" to generate printouts, which refers to forming and using electrostatic charged patterns to record and reproduce information, a "xerographic process", which refers to the use of a resinous powder on an electrically charged plate record and reproduce information, or other suitable processes for generating printouts, such as an ink jet process, a liquid ink process, a solid ink process, and the like.

As used herein, "substrate media" refers to, for example, paper, transparencies, parchment, film, fabric, plastic, or other substrates on which information can be reproduced, preferably in the form of a sheet or web.

As used herein, "module" refers to each of a series of standardized units or subassemblies from which a printing system can be assembled. It should be understood that different modules can perform the same and/or different functions in the printing system, but are standardized to be selectively interconnected and operate together. A "transport module" is capable of moving substrate media through its own subassembly.

As used herein, "feeder trays" refer to compartments for holding substrate media to be fed through a printing system.

As used herein, "belts" refer to one or more continuous bands for transferring motion or conveying substrate media in a printing system. Also, "belt edge sensors" refer to one or more devices used to obtain belt edge information, such as detecting the presence and/or position of a moving belt in a printing system. Belt edge sensors are typically used to provide a warning or shut-down a system if a belt slides toward either edge of its corresponding drive roller. Typically, such sensors provide an indication for motion of at least 1-2 mm, however they can generally detect smaller amounts of motion. Additionally, "belt steering controls" refer to an assembly within a printing system capable of changing the direction, position and/or orientation of a moving belt in a printing system.

FIG. 1 depicts a top view of a series of belt driven substrate media transport modules 11-16 used in a printing system. Each module 11-16 includes a driven belt 21-26 to engage and transport substrate media (not shown) through the module. This exemplary illustration includes photo-receptor drums 31-36 for transferring imaging to substrate media in all the modules. While overprinting printing systems generally include more than one printing module, it should be understood that not all modules need to include a photo-receptor drum or other image transfer. For example, modules can include other substrate media processing such as overcoat applications, sheet and/or image sensing/property measurement, media conditioning or fusing. Substrate media transported through the modules 11-16 pass generally in the process direction P, with the cross-process direction representing lateral movement perpendicular to the process direction P.

FIG. 1 shows a series of six belt driven transport modules 11-16. Preferably, the modules 11-16 are similar in size and configuration, such that they are interchangeable. Such modular design allows rearrangement of modules as well as the addition or subtraction of modules in order to suit the desired processing.

When modules 11-16 are misaligned, the belt transport velocity vectors $V_1$, $V_2$, $V_3$, $V_4$, $V_5$, $V_6$ are not parallel. It should be understood that the module-to-module skew shown in FIG. 1 is generally exaggerated for illustrative purposes. Thus, belt 21 has a transport velocity $V_1$ and belt 22 has a transport velocity $V_2$, which are misaligned by an angle $\theta_1$. When the angle $\theta_1$ is greater than zero (0), the two modules 11, 12 are skewed from one another. It is generally desirable to align/re-align the modules 11-16 such that the velocity vectors of all transport belts are substantially parallel to one another. In this way, they are said to be aligned.

Figure 2:
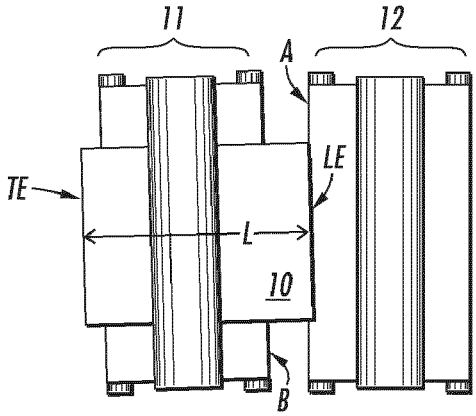
FIG. 2 is a plan view of a substrate media in an entry position passing through two transport modules.
Figure 3:
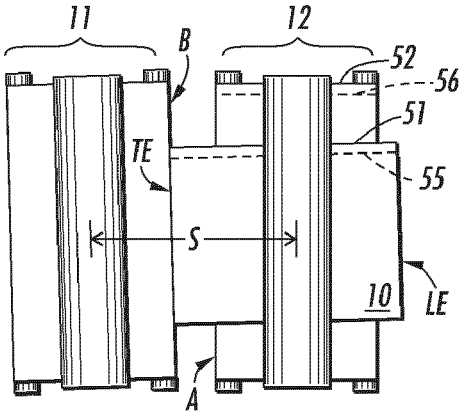
FIG. 3 is a plan view of a substrate media in an exit position passing through two transport modules.

Each module 11-16 has an entry and an exit, so as substrate media moves along the process direction P through a module it will pass from its entry side A to its exit side B. During substrate media transfer between two modules, for example modules 11 and 12, an entry position (as shown in FIG. 2) is defined by when the leading edge LE of the substrate media 10 reaches the module 12 entry A. Similarly, an exit position (as shown in FIG. 3) is defined by when the trailing edge TE of the substrate media 10 reaches the module 1 exit B. Because the module belts firmly grip the substrate media 10, the angular misalignments $\theta_1$, $\theta_2$, $\theta_3$ can cause the substrate media 10 to transmit a skewing force to the downstream belt. That skewing force will tend to make the downstream belt walk, slide or shift, in addition to possibly making the substrate media 10 tear, crease or buckle.

Depending on the amount of misalignment between adjacent modules, the cross-process position of substrate media 10 as it passes through a module may not match the substrate media cross-process position as it passes through the next module. Also, such a position mismatch can accumulate across additional modules depending on which belt velocity vector the substrate media 10 follows. For example, FIG. 3 further illustrates two different positions 51, 55 of substrate media 10 depending from which belt it was driven. Thus, the more outboard position 51 shows the position of substrate media 10 had it been driven by module 11 alone. The more inboard position 55 shows the position of substrate media 10 had it been driven by module 12 alone. Note the positional mismatch (the difference in cross-process position) of those two substrate media positions 51, 55. Similarly, the drive belts follow the substrate media causing an equal or substantially similar shift in the belt so that a first belt position 52 corresponds to substrate media position 51 and a second belt position 56 corresponds to substrate media position 55.

The maximum amount of accumulated error $\Delta x$ can be derived from the following equation.

$$\Delta x = \frac{\Delta v}{v_d}(L-S) \quad (1)$$

Where L is the substrate media length (as shown in FIG. 2), S is the module-to-module spacing (as shown in FIG. 3), $v_d$ is the nominal belt velocity and Δv is the velocity mismatch vector.

A velocity mismatch vector can then be calculated as follows:

$$\Delta v_P = v_d(1-\cos(\theta)) \quad (2)$$

Representing velocity mismatch in the process direction.

$$\Delta v_C = -v_d \sin(\theta) \quad (3)$$

Representing velocity mismatch in the cross-process direction.

Positional mismatches can then be derived by combining equation 1 with equations 2 and 3 respectively as follows:

$$\Delta x_P = (1-\cos(\theta))(L-S) \quad (4)$$

Representing positional mismatch in the process direction.

$$\Delta x_C = -\sin(\theta)(L-S) \quad (5)$$

Representing positional mismatch in the cross-process direction. Equations 4 and 5 can be used to estimate and/or determine the maximum positional mismatch to be expected for a particular system and the substrate media used to align the system.

The accumulation of these misalignment errors is largest for long substrate media. Also, even small module-to-module misalignment errors can accumulate, causing large error magnitudes. For example, between 16 inch wide modules moving 26 inch long substrate media, a relatively small misalignment of 0.25 mrads, corresponding to a 0.1 mm distance error from the inboard side (the bottom side as illustrated in FIGS. 1-4) to the outboard side (the top side as illustrated in FIGS. 1-4) can translate into a 140 μm cross-process direction error. Such large errors are unacceptable for many applications, such as color-to-color registration.

Additionally, the forces transmitted between two modules will be maximized if the substrate media can transmit large forces without buckling, creasing or tearing. Accordingly, performing module alignment using long, heavy-weight stiff substrate media will more readily reveal misalignments. Such heavy-weight substrate media can be over 200 gsm (grams/meter$^2$) and preferably at least 300 gsm. Also, while substrate media length is often limited by the in process feeder trays, span across or between modules or other factors, the length of the substrate media used during alignment should be maximized to the extent appropriate. Long substrate media is preferably at least as long as a minimum distance between modules wherein both adjacent modules still engage and/or grip the substrate media. In a printing system using common contemporary substrate media, lengths of at least 17"-26" are preferred.

Note that the positional mismatches calculated by equations 4 and 5 are worst-case scenarios. Actual errors may be smaller depending on other factors, such as substrate media deformation, sheet-to-belt slip, belt walk. Although such other factors can absorb or negate at least some of the position error, they are not themselves generally desirable.

Accordingly, each belt and its associated belt edge sensor(s) are used to detect cross-process pulling or pushing that occurs during substrate media transfers. Thus, the modules can further be aligned by adjusting the alignment angle between modules until any belt walk is minimized.

Figure 4:
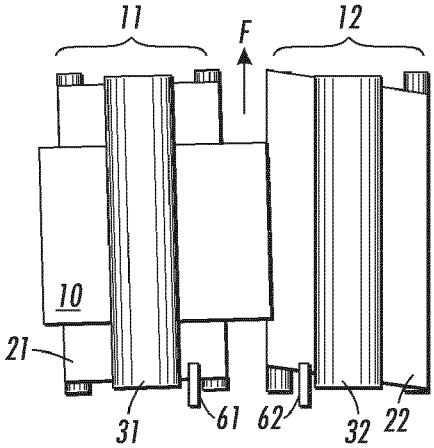
FIG. 4 is a plan view as shown in FIG. 2 with a transport module belt skewed.

FIG. 4 illustrates the movement of the module belt 22 due to a lateral forces F in a cross process direction, particularly an outboard direction is shown. Such forces can be transmitted to the belt 22 through the substrate media 10 between modules during substrate media transfer. The belt edge sensors 61, 62 detect information regarding the edges of belts 21, 22. In particular, the sensors 61, 62 preferably detect un-evenness or misalignment of the edges. Note how the entry-side A of the module 12 belt 22 is further toward the outboard side than the exit-side B of both belts 21, 22. This type of belt misalignment once detected is an indication of transport module skew and should be corrected in order to align the transport modules. It should be noted that in FIG. 4, as substrate media 10 has just reached the downstream module 12, the belt deflection shown for belt 22 was likely caused by a prior substrate media recently passed through the modules 11, 12.

It should be understood that there can be variations of detected belt misalignment as either multiple sheets or single sheets passed through the modules. Accordingly, suitable filtering and/or averaging is preferably performed to make the alignment insensitive to these variations, and only address the static module-to-module skew misalignment. For example, the average induced belt movement of the last 5 substrate media transferred could be used to determine the alignment actions.

Figure 5:
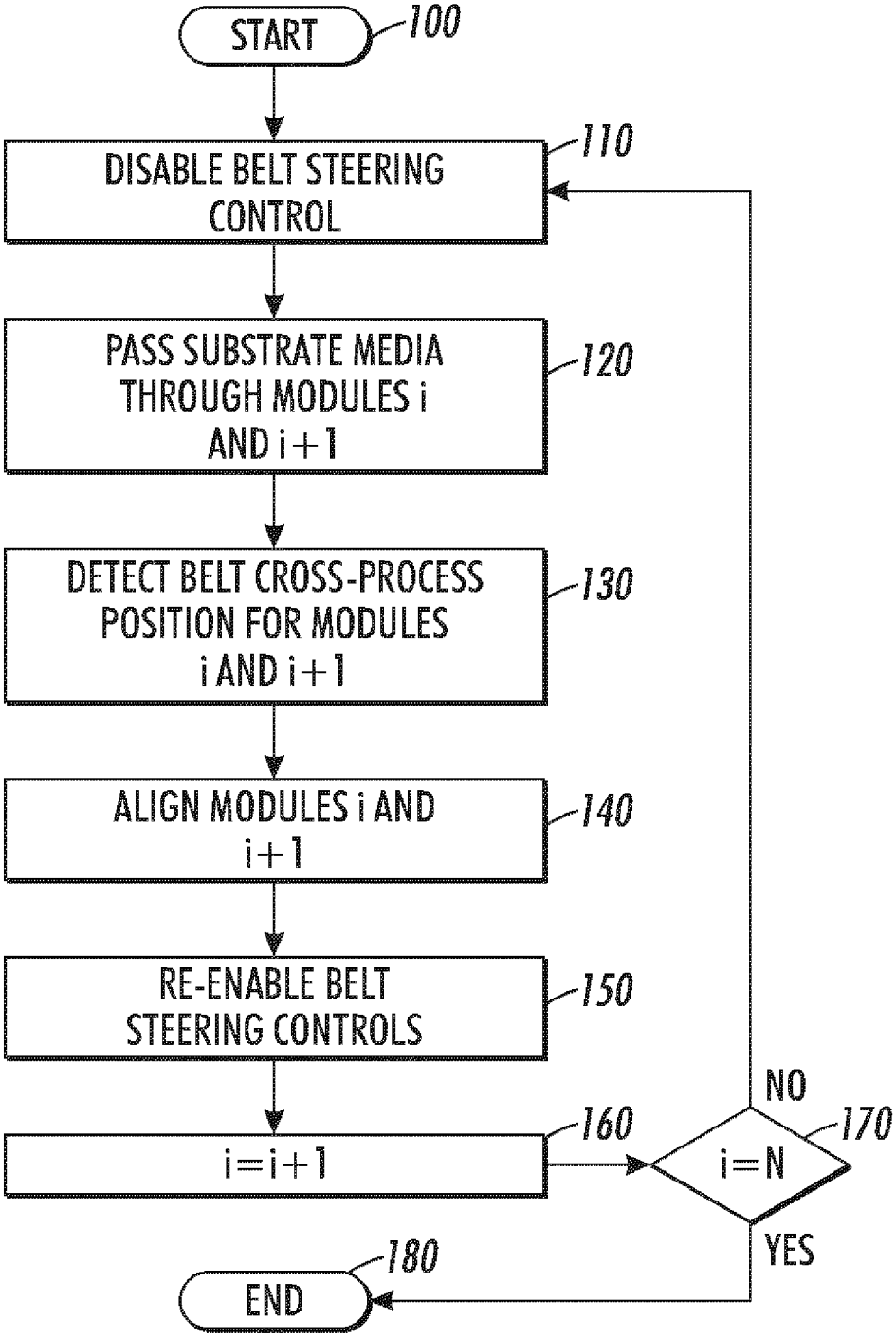
FIG. 5 is a block diagram showing the method of aligning transport modules in a printing system.

FIG. 5 illustrates a method of aligning transport modules in a printing system. The method can be performed during initial set-up of the system or as a maintenance procedure to re-align modules. In step 100 the alignment procedure is initiated (start). Then in step 110 the belt steering controls are disabled. It should be understood that a disabled state for the steering controls can include a low gain, fully disabled or dead zone state so that the control does not try to counteract any skew. Also, safety limits can remain enabled for the steering controls in order to prevent a belt from walking off the rollers driving the belts. Further, the steering control for all belts need not be disabled, but at least the steering controls for the two adjacent modules being measured/aligned are preferably disabled. In step 120, at least one substrate media is passed from a first module i to last module N (where N is the total number of modules) through all the intervening modules i+1 to N−1 between. Preferably, the substrate media used in this step is at least one of a large and heavy sheet. In step 130, a belt cross-process position is then measured/detected at the exit of module i and the entry of module i+1. In step 140, module i+1 is aligned relative to module i so that the induced belt motion is minimized as each substrate media is transferred. This modular alignment is preferably an angular modular alignment and is performed by at least one module aligner 41-46 (shown in FIG. 1). The modular aligner 41-46 can be a human operator or an automated electromechanical system. The triangular elements 41-46 shown in FIG. 1 are merely representative of such systems and are not intended to limit the placement of such system with relation to each module. In step 150, the belt steering controls for modules i and i+1 are re-enabled. Then in step 1601 is incremented up to equal i+1. In this way steps 110 through 160 are repeated until i equals N in step 170, then in step 180 the alignment process is finished. In this way, the first two modules are aligned, then the second and third two modules are aligned, etc., until the last two modules are aligned and all the transport modules are mutually aligned.

To help prevent belts being pushed off rollers the alignment procedure can be started with shorter substrate media, since the belt movement during substrate media module-to-module transfers is roughly proportional to (L−S). Note that the angular alignment of modules could be performed by an operator or by automatic, electro-mechanical systems.

While only a portion of each module's subassembly is illustrated for clarity and convenience, it should be understood that these elements are part of a greater printing system. Also, while various components (parts) are shown as the same in all of the illustrated modules and/or embodiments, variations in these elements can be introduced as desired.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method of aligning transport modules in a printing system, the method comprising:

passing at least one substrate media in a process direction through adjacent first and second transport modules, each of the first and second transport modules including a transport belt for engaging and conveying the at least one substrate media, at least one of the first and second transport modules having a transport belt steering control disabled;

detecting a first position of a first edge of the transport belt in the first transport module, the first position representing a cross-process position of the first edge measured by at least one first edge sensor;

detecting a second position of a second edge of the transport belt in the second transport module, the second position representing a cross-process position of the second edge measured by at least one second edge sensor; and aligning the first and second transport modules based on a relative skew indicated by the first position and the second position.

2. The method of aligning transport modules of claim 1, further comprising:

passing at least one additional substrate media through the first and second transport modules and a third transport module, the third transport module being adjacent to the second transport module; and aligning the third transport module with at least one of the first and second transport modules.

3. The method of aligning transport modules of claim 1, further comprising:

passing additional substrate media through further adjacent pairs of transport modules in the printing system for aligning those further adjacent pairs of transport modules with at least one of the first and second transport modules.

4. The method of aligning transport modules of claim 1, wherein the at least one disabled belt steering control includes the belt steering controls in both the first and second transport modules.

5. The method of aligning transport modules of claim 1, wherein the first position and the second position correspond to at least one of a module exit and a module entry position.

6. The method of aligning transport modules of claim 1, further comprising:

calculating a cross-process direction positional misalignment $\Delta x_c$ based on the first position and the second position, a length L of the substrate media, a module-to-module spacing S and an angular misalignment θ between the two adjacent transport modules.

7. The method of aligning transport modules of claim 6, wherein the calculation includes using:

$$\Delta x_c = -\sin(\theta)(L-S).$$

8. The method of aligning transport modules of claim 1, further comprising:

calculating a process direction positional misalignment $\Delta x_p$ based on the first position and the second position, a length L of the substrate media, a module-to-module spacing S and an angular misalignment θ between the two adjacent transport modules.

9. The method of aligning transport modules of claim 8, wherein the calculation includes using:

$$\Delta x_p = (1-\cos(\theta))(L-S).$$

10. The method of aligning transport modules of claim 1, wherein the substrate media is at least 200 gsm in weight.

11. The method of aligning transport modules of claim 1, wherein the shortest one of the at least one substrate media is at least as long as a minimum distance between the two adjacent transport modules, whereby the two adjacent transport modules can simultaneously engage the substrate media.

12. The method of aligning transport modules of claim 11, wherein the substrate media is at least 200 gsm in weight.

* * * * *